United States Patent [19]

Taft et al.

[11] 4,176,986

[45] Dec. 4, 1979

[54] SUBSEA RISER AND FLOTATION MEANS THEREFOR

[75] Inventors: Daniel G. Taft; Joe K. Heilhecker, both of Houston, Tex.

[73] Assignee: Exxon Production Research Company, Houston, Tex.

[21] Appl. No.: 848,170

[22] Filed: Nov. 3, 1977

[51] Int. Cl.[2] ..... E21B 7/12

[52] U.S. Cl. ..... 405/211; 9/8 P; 166/350; 405/195

[58] Field of Search ..... 61/86, 97, 112; 9/8 R, 9/8 P; 166/0.5, 350; 175/7; 405/195, 211

[56] References Cited

U.S. PATENT DOCUMENTS

| | | | |
|---|---|---|---|
| 3,633,369 | 1/1972 | Lawrence | 61/97 |
| 3,992,889 | 11/1976 | Watkins et al. | 61/86 |
| 4,037,425 | 7/1977 | Berg | 61/112 |
| 4,040,264 | 8/1977 | Neilon | 61/86 |
| 4,059,148 | 11/1977 | Blomsma | 166/0.5 |
| 4,099,560 | 7/1978 | Fischer et al. | 166/0.5 |

FOREIGN PATENT DOCUMENTS

| | | | |
|---|---|---|---|
| 1285530 | 8/1972 | United Kingdom | 61/86 |

*Primary Examiner*—David H. Corbin

*Attorney, Agent, or Firm*—Robert L. Graham; Robert B. Martin; Michael A. Nametz

[57] ABSTRACT

A marine drilling riser is provided with a plurality of buoyancy cans having fail safe dump valves operative to vent compressed gas from the buoyancy cans and thereby cause rapid loss of buoyancy.

22 Claims, 6 Drawing Figures

SUBSEA RISER AND FLOTATION MEANS THEREFOR

BACKGROUND OF THE INVENTION

1. Field of the Invention

The present invention relates to a marine drilling riser provided with improved buoyancy cans. In one aspect, the invention relates to an improved buoyancy can having vent means for rapidly venting compressed gas.

2. Description of the Prior Art

A substantial amount of exploratory drilling for deposits of crude oil and natural gas situated offshore is conducted from floating vessels. Such operations normally employ a marine riser which extends between the vessel and the subsea well. The riser consists of a number of sections of pipe connected together in end-to-end relation and serves to guide the drill string into the well and conduct drilling returns back to the vessel.

The riser must be supported in tension to prevent buckling due to several forces including (a) its own weight, (b) pressure differential caused by heavy drilling fluid, and (c) forces acting on it as a result of waves, current, and the like. Such support is normally provided by tensioning devices mounted on the drilling vessel and external buoyancy means connected to the riser. External buoyancy devices include buoyancy cans and/or modules longitudinally spaced along the riser pipe.

Positively buoyant risers of this construction present a serious hazard. In the event the riser breaks, the riser will be propelled upwardly by the buoyancy cans and possibly torpedo the drilling vessel or other work vessels in the area. This hazard has severely limited the use of a positively buoyant riser. Instead, buoyancy cans are designed to provide only a portion of the buoyancy needed to support the riser, the remaining riser support being provided by cumbersome and complex tensioning devices positioned on the vessel.

Another problem associated with buoyant risers and self-standing risers is that of maintaining sufficient tension on the riser when it is disconnected from the subsea wellhead. Disconnection of the riser may subject the riser to high lateral stress due to subsea currents. To offset these forces, the riser should be in tension due to its own weight. However, the buoyancy imparted by the buoyancy cans may reduce the net weight of the riser sufficiently to cause the riser to be damaged by sea currents.

In summary, there exists a need to rapidly eliminate or reduce the buoyancy on risers when the riser fails or is disconnected from the wellhead.

U.S. Pat. No. 3,992,889 discloses a buoyancy can provided with means for bleeding gas from the buoyancy chamber. However, the purpose of the bleed means is to adjust buoyancy in the chamber and, because of its structure, the bleed means would not operate within a time frame required to avoid the hazards described above.

SUMMARY OF THE INVENTION

The purpose of the present invention is to provide a marine riser with buoyancy cans constructed to avoid the problems described above. A plurality of buoyancy cans are located at longitudinal intervals along the riser. Each can preferably defines an annular buoyancy chamber that surrounds the riser. The chamber is open at the bottom end so that compressed gas can be introduced and maintained in the annular chamber.

In accordance with the present invention, each buoyancy can is provided with a dump valve that is operative to release gas from the chamber in response to a break occurring in the riser or in response to disconnection of the riser from the wellhead.

The dump valve is sized to release the gas rapidly (preferably within 1 to 20 seconds) and thereby eliminate buoyancy before the riser has moved sufficiently to damage the vessel or the riser itself. Depending on the size and depth of the buoyancy cans, the dump valve will have a discharge port of between about 20 and about 300 square inches. Discharge areas larger than about 100 square inches may require the use of a plurality of dump valves in each buoyancy can.

In a preferred embodiment, the dump valve is of fail-safe construction, maintained in the closed position by a hydraulic control means. Hydraulic pressure through a suitable line extending from the drilling vessel operates a pilot valve on the dump valve. With the pilot valve in the hydraulically energized position, pressure within the buoyancy chamber aids in maintaining the dump valve closed. In the hydraulically de-energized position of the pilot valve, the dump valve opens releasing gas from the buoyancy chamber. The pilot valve automatically becomes de-energized by parting of the riser or by disconnection of the riser from the wellhead. The relatively large opening of the dump valve (preferably at least 20 square inches) quickly releases gas from the chamber. The elimination or reduction of buoyancy on the riser avoids the hazards described above.

DESCRIPTION OF THE PREFERRED EMBODIMENT

Figure 1:
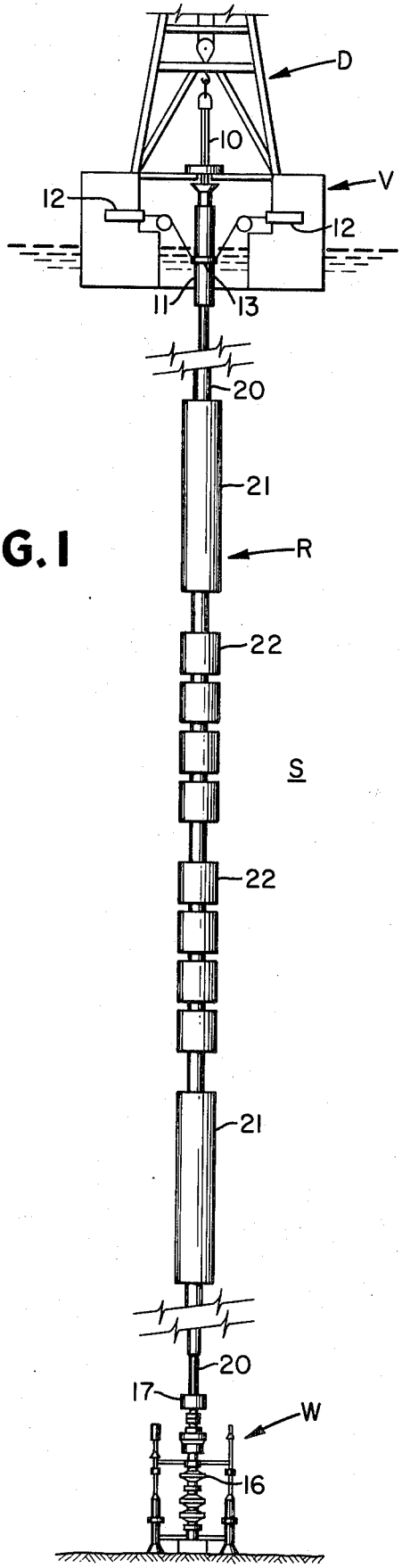
FIG. 1 is a schematic side elevation of the riser system constructed according to the present invention.

Referring to FIG. 1, a riser system R is shown extending from a floating drilling vessel V downwardly through a body of seawater S to subsea wellhead W. The vessel V includes a derrick D for supporting a drill string 10, which extends downwardly through an opening in the vessel V, through riser R and wellhead and into the subsea well. As mentioned previously, the riser R guides the drill string into the subsea well and provides a conduit for the drilling fluid to return to the vessel V.

An upper end portion of the riser R includes a slip joint assembly 11 which permits relative vertical movement between the vessel V and riser R. Tensioning devices, designated by numeral 12, are positioned on the vessel and are attached to a clamp ring 13 affixed to the lower barrel of slip joint 11. Tensioners 12 function to exert a vertical tensile force on the riser R in a manner well known in the art.

The riser R is pivotally connected to a blowout preventer stack 16 of the wellhead w by means of a ball joint 17. The slip joint assembly 11, tensioning devices 12, wellhead W, and derrick D may be of a wide variety of conventional construction and therefore are depicted schematically in FIG. 1.

The riser R consists of a plurality of individual sections 20 connected together in end-to-end relationship. These sections are commonly available in lengths from 40 to 75 feet and diameters from 16 inches to 18⅝ inches. A sufficient number of buoyancy devices are spaced longitudinally along the riser R to impart the desired buoyancy to the system. (An intermediate portion of the riser R is enlarged in FIG. 1 to better illustrate the size relationship of the buoyancy devices and the riser.)

In the embodiment illustrated in FIG. 1, the buoyancy devices include buoyancy cans 21 and foam float modules 22. A sufficient number of the float modules 22 are uniformly interspersed with the buoyancy cans 21 to provide the riser with at least 90% neutral buoyancy with the air cans filled with water.

Figure 2:
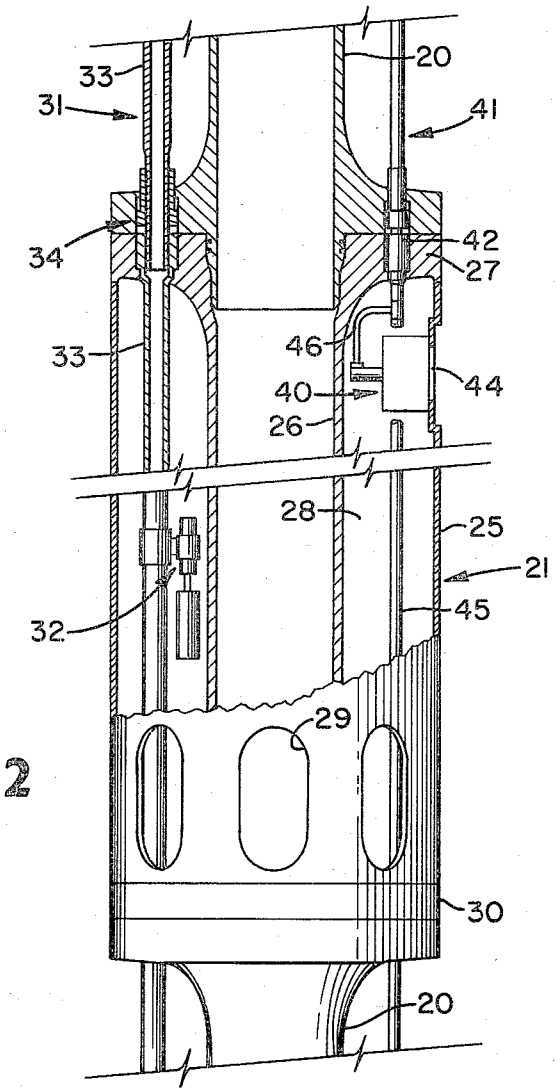
FIG. 2 is a side elevational, shown partially in section, illustrating a buoyancy can shown in FIG. 1.

Details of each buoyancy can 21 are shown in FIG. 2. The can comprises an outer cylindrical shell 25 which surrounds riser section 26 and is closed at its upper end by flange 27. Flange 27 may form a part of the coupling interconnecting riser sections 20 as illustrated. Shell 25, section 26 and flange 27 define an internal annular buoyancy chamber 28. The lower end of the can 21 is open as by ports 29 and lower flange 30 provides structural strength for the can. A gas fill line 31 extends from the surface to each buoyancy can and provides means for delivering compressed air or gas into chamber 28. Each riser section 20 and each can 21 are provided with a fill line tube 33 that mates with adjacent tubes when the riser sections and cans are assembled in end-to-end relationship. Each tube 33 has its upper and lower ends secured to flanges 27 and 30, respectively. Connections 34 for joining adjacent tubes 33 may be of pin-and-box construction as illustrated.

Chamber 28 has mounted therein a float valve 32 for controlling introduction of gas from line 31 into the chamber 28. The injection line 31 and float assemblies 32 may be similar to that described in U.S. Pat. No. 3,992,889.

The riser may also include BOP lines and kill lines, but, for purposes of simplicity, these lines are not shown. None of the auxiliary lines (e.g. fill lines, kill lines, BOP actuator lines) are illustrated in FIG. 1.

A dump valve (illustrated generally as 40 in FIG. 2) is provided in an upper portion of chamber 28 and serves to rapidly vent the compressed air when a rapid loss or reduction of buoyancy is desired. The dump valve 40 preferably is hydraulically actuated. Hydraulic pressure is delivered to the dump valve 40 by hydraulic line 41 which may be of construction and assembly similar to the gas fill line 31. The hydraulic line 41 is of sectional construction comprising individual tubes 45 and extends from the vessel V through the buoyancy cans and terminates at wellhead W in a blind pin-and-box connection (not shown). The individual sections 45 are interconnected by pin-and-box connections 42 at the riser coupling flanges (e.g. 27 and 30). A hydraulic line 46 interconnects the dump valve 40 and line 41.

Figure 3:
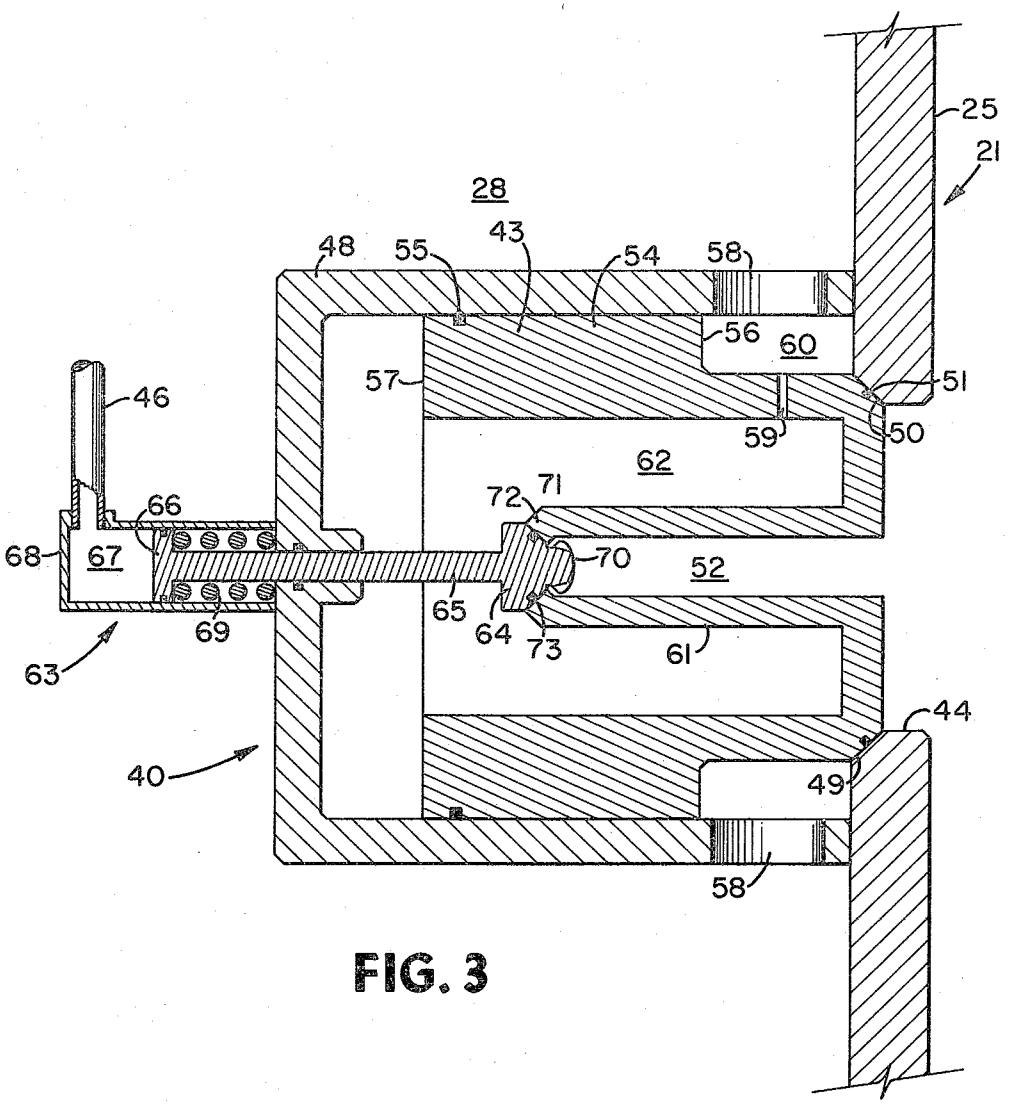
FIG. 3 is an enlarged sectional view of a portion of the buoyancy can shown in FIG. 2, illustrating details of a dump valve.

As best seen in FIG. 3, the dump valve 40, secured to the interior of shell 25 of the buoyancy can 21, includes housing 48 and valve member 43 reciprocally mounted within the housing 48. The valve member 43 closes a port 44 formed in the buoyancy can shell 25. The outer extremity of the valve 43 is beveled as at 49 and is adapted to seat with a complimentary shaped surface 50 surrounding opening 44. A sealing element such as an O-ring 51 may be employed to provide a fluid tight seal.

The valve member 43 also includes a flanged skirt 54 which defines an outwardly facing surface 56 and an inwardly facing surface 57. A seal such as O-ring 55 may be used to secure a fluid tight fit between the skirt 54 and the interior of housing 48. Outwardly of surface 56 is an annular chamber 60 which communicates with the interior of the valve member 43 by bleed orifice 59 and with the buoyancy chamber 28 through large ports 58. The valve member 43 and housing 48 are configurated to define internal chamber 62. The valve member 43 also includes tube 61. The passage through tube 61 provides fluid communication between chamber 62 and the exterior of can 21.

The valve member 43 is maintained in the closed position by a pilot valve assembly 63 which includes a pilot valve member 64 adapted to seat on the internal end 72 of tube 61. The pilot valve member 64 also includes a stem 65 that extends through the housing 48 terminating in piston 66. The piston 66 is mounted for reciprocation within pilot housing 68 which is secured to valve housing 48. The pilot housing 68 in combination with piston 66 defines hydraulic chamber 67. Chamber 67 is connected to hydraulic line 46 such that hydraulic pressure delivered to chamber 67 by lines 41 and 46 moves the piston 66 within housing 68 to the right as viewed in FIG. 3. forcing pilot valve member 64 into sealing engagement with the inner end 72 of tube 61. Valve member 64 and the inner end 72 of tube 61 may be complimentary shaped as illustrated to provide a fluid tight seal. A sealing element 73 may also be provided on member 64 to insure a fluid tight seal. A compression spring 69 acting between housing 48 and the underside of piston 66 urges the valve member 64 away from the tube end 72.

In the energized (pressurized) position of the pilot valve 63, chamber 67 will be pressurized to a predetermined level by hydraulic fluid delivered through lines 41 and 46. This forces the pilot valve member 64 into seating engagement with tube end 72 thereby closing opening 52. Hydraulic force acting through members 66, 65 and 64 urges the valve member 43 into seating engagement with surface 50 which closes port 44. Air passing through ports 58 and orifice 59 permits the inner valve chamber 62 to equalize with the pressure in buoyancy chamber 28. This pressure exceeds the external water pressure at port 44 because of the displaced water in chamber 28. The differential pressure across member 43 insures a fluid tight seal. The differential pressure is equal to the length of the air column in can 21 times the density of the sea water. For most air cans the differential pressure ranges from about 12 psi to about 33 psi.

When loss of buoyancy is required, as for example occasioned by a break in the riser, hydraulic pressure in line 41 is released reducing the pressure in chamber 67. Spring 69 forces the pilot valve member 64 away from tube 61 opening passage 52. Pressure within internal valve chamber 62 quickly equalizes with the external sea water. Orifice 59 has a small flow capacity so that the pressure within chamber 60 momentarily exceeds the pressure within chamber 62; the imbalance of forces across skirt 54 causes the valve 43 to snap open, which permits the pressurized air to dump into the surrounding sea water. The passage 52, orifice 59, and surface 56 are sized to cause the valve member to move from the fully closed position to the fully open position within 0.5 seconds from reduction of the pressure in chamber 67 to a level below said predetermined pressure.

The predetermined hydraulic pressure required to maintain the valve 43 in the closed position will depend upon the strength of the spring 69. An 8-inch valve constructed according to the present invention employed a spring that required 1200 psi in chamber 67 to close the valve.

It should be noted that variations in the dump valve are possible. For example, a tension spring employed within the housing 48 may be used instead of a compression spring 69. Also the pilot valve member 64 may be constructed with a flared end as at 70 to engage an internal shoulder 71 of tube 61 to aid in moving the valve member 43 to the open position.

As mentioned previously, it may be desirable to use the buoyancy cans 21 constructed according to the present invention along with other buoyancy means such as syntactic foam floats 22 (see FIG. 1). The syntactic foam floats spaced along the riser will provide buoyancy for the riser R prior (preferably at least 90% of neutral buoyancy) to the injection of air into the buoyancy cans 21 or after buoyancy has been eliminated from the cans. This reduces the downward load on the derrick. The syntactic foam floats 22 may be of conventional construction which are normally split members strapped about the riser. In a typical installation of a 5000-foot riser, the system will include 20 buoyancy cans and 80 joints of syntactic float modules.

The installation of the riser R may be in accordance with conventional practice. The riser sections will be assembled in the normal manner and lowered from the vessel and located on the wellhead W.

Prior to introduction of the air into the cans 21, hydraulic pressure is delivered by a suitable pressure source located on the vessel to each can via line 41 to energize the pilot valves 63 and maintain the dump valves 40 in their closed positions.

When the riser is properly positioned and the dump valves 40 are closed, gas such as air will be injected through line 31 to fill the various air cans 21. The air entering each buoyancy chamber 28 displaces sea water from the can until the float 32 is actuated.

Upon completion of the injection of the air, drilling or well operations may commence.

In the event of failure of the riser R, as for example buckling, the hydraulic line 41 will either part because of the pin-and-box connections or the hydraulic line will be pulled free of the blind connection at the wellhead W. In either event, hydraulic pressure will be lost which deenergizes the pilot valve causing the dump valve to open. The compressed air rapidly dumps into the surrounding sea water through port 44 thereby eliminating buoyancy from the air cans in the manner described above. The air can closest to the failure will dump first. It's important that the initial air can dump within one second from the loss of hydraulic pressure. In practice, location of air cans within 1000 feet of one another will insure rapid dumping of the air cans.

From the foregoing it will be appreciated that the opening 44 and the dump valve should be sized to permit rapid equalization of the pressure within and without the buoyancy can. This of course will depend upon several factors. However, the buoyancy should be eliminated before the slip joint has moved to its upper limit. Moving beyond this point would damage the drilling vessel or equipment. This means that for conventional slip joints having a full stroke of 60 feet, the buoyancy must be eliminated within 30 feet (preferably within 20 feet). To insure this rapid equalization of pressure, the buoyancy system should be designed to eliminate excess buoyancy 20 seconds. For most standard size buoyancy in cans, a port having a flow area of at least 20 square inches will be required. Thus the dump port is at least about 20 times larger than the standard 1-inch gas injection line. For large diameter and volume (up to 750 cubic feet) the flow area may range as large as 100 to 500 square inches. Such large flow areas may require more than one dump valve on each can. The time from de-energization of the pilot valve for the valve member 43 to move from the fully closed to the fully open position should be not more than 0.5 seconds, and preferably not more than 0.25 seconds. The time for the compressed gas to dump will vary depending on depth. An air can at 10,000 feet should dump within 20 seconds from the opening of the dump valve.

The following experiments on a dump valve illustrate the operation of the valve. The dump valve was designed for use with a buoyancy can having an OD of 42 inches and an ID of $18\frac{5}{8}$ inches. The opening 44 of the valve was 8 inches and the pilot valve had an ID of 1 7/16 inches. Hydraulic pressure of 1800 was employed to maintain the valve in the closed position. The test providing air flow information on the valve. By comparing the measured data with theoretical calculations it is possible to determine the pressure losses in the valve. The test data indicates that the valve designed is highly efficient. The equation for calculating flow rate of a compressible fluid is:

$$w=0.525Fd^2\sqrt{\Delta P/KV}$$

where:

F=expansion factor
d=valve diameter (inches)
ΔP=differential pressure across valve (psi)
K=flow coefficient
V=cu ft/# of fluid
w=flow rate in pounds per second The K value is a function of the entrance and exit losses into and out of the valve and the losses through the valve. The lower the K value, the more efficient the valve. The dump valve has a K value of about 1.0 which corresponds to punching a hole in the air can with the same diameter as the valve.

The hydraulic pressure required to close the valve was 1200 psi and the actual hydraulic pressure applied was 1800 psi. From the instant breaking of the hydraulic line, 0.045 seconds was required for the pilot valve to open and 0.177 seconds was required for the main valve to open.

It will be realized by those skilled in the art, that the particular structure and configuration of the air can employing the dump valve may be different than the concentric construction illustrated in FIG. 2. For example, the air can may be of split configuration such as that illustrated in FIGS. 4, 5 and 6 wherein each air can consists of two housing members 80 and 81. (The parts illustrated in FIGS. 4, 5 and 6 corresponding to those illustrated in FIGS. 2 and 3 are identified by like reference numerals.)

The housing members 80 and 81 are shaped complimentary to each other and are adapted to be mounted around a riser joint 20 and secured in place by straps 83 and 84. Both housing members are open at the bottom and one housing member 80 is provided with a gas injection valve (not shown) similar to valve 32 shown in FIG. 2. Compressed air is introduced into housing member 80 by gas line 31.

Figure 5:
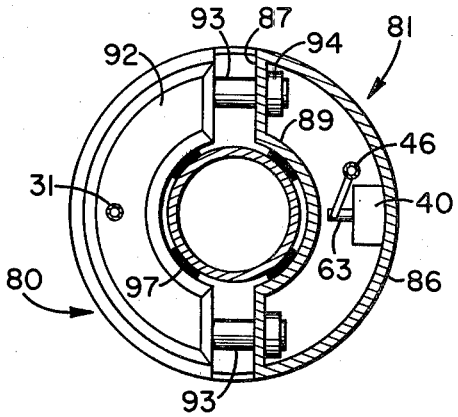
Figure 6:
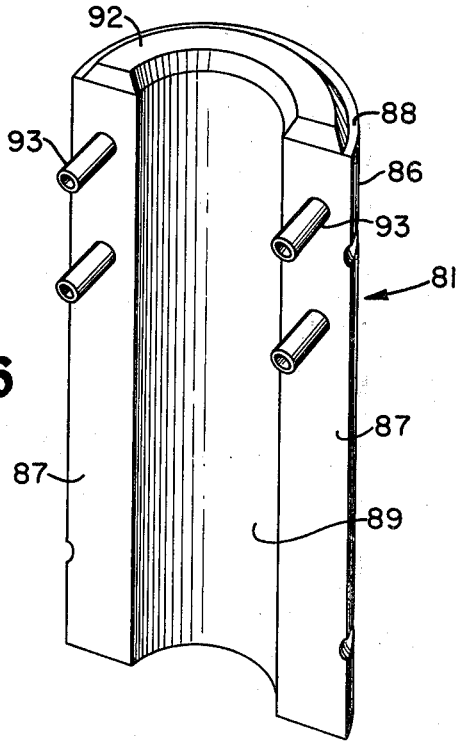

As best seen in FIGS. 5 and 6, each housing member 80 and 81 includes an outer semicircular member 86, an inner semicircular member 89 and end panels 87 which interconnect the longitudinal edges of members 86 and 89. The upper end of each housing 80, 81 is closed by end closure members 88 and the lower end may be open. Strapping grooves 91 may be provided in the outer semicircular member 87 to assist in securing the can to the riser. Mounted on each closure member 88 is a thrust member 92 adapted to engage the riser collar 27.

Figure 4:
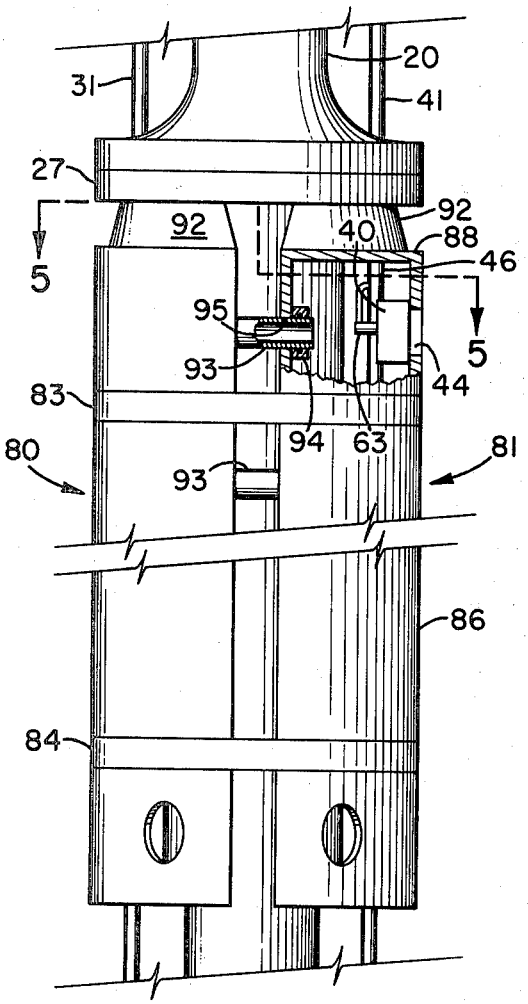
FIGS. 4, 5 and 6 illustrate another embodiment of the present invention.

In order to provide fluid communication between members 80 and 81, crossflow tubes 93 are provided in panels 87. The crossflow tubes 93 may be of pin-and-box construction wherein each tube fits into a complimentary shaped receptacle such as 95 shown in FIG. 4. Each tube 93 is adapted to fit in a receptacle 95 of its paired housing member. As shown in FIGS. 4 and 5, the receptacle 95 may include an internal sleeve 94 adapted to receive the tube 93. A seal mounted in sleave 94 provides a fluid tight seal at the connection.

Mounted in the upper end of one of the housing members (e.g. 81) is a dump valve 40 which may be similar in construction as that illustrated in FIG. 3. Dump valve 40 closes port 44 and is maintained in the closed position by hydraulic pressure delivered through lines 41 and 46 to pilot valve assembly 63. In the event more than one dump valve is required in each air can assembly, a second dump valve can be provided in the other can member such as in member 80.

The air can members 80 and 81 may be constructed of metal or of molded plastic.

The principal advantages of split air can construction illustrated in FIGS. 4, 5 and 6 over concentric buoyancy cans is that they can be installed on an existing riser or can be used to replace the float-type buoyancy devices.

In installing the split buoyancy can, each housing member 80, 81 is positioned about the riser R and slipped in place using the paired tubes 93 and receptacles 95 as guidance members to obtain proper alignment. With the cans properly placed, the straps 83 and 84 are used to secure the cans to the riser. In the event air cans have not been previously used on the riser, it will be necessary to run a gas line 31 and connect it to each of the paired assemblies. The hydraulic line 41 is also run from the vessel to each of the paired cans. Flexible mounting lugs 97 may also be employed to assist in mounting and aligning the cans on the riser.

In summary, the buoyancy can provided with the fail safe dump valve offers safety features for marine risers that are not possible with presently available buoyancy devices. While the present invention has been described with specific reference to buoyancy risers, it would be understood that it may be used with any type of risers including self-standing risers.

We claim:

1. A buoyancy can for use on a self-standing riser at subsea depths having a slip joint in the upper portion thereof, said buoyancy can comprising:

(a) a housing defining a buoyancy chamber adapted to receive a compressed gas, said housing having a port formed in an upper portion thereof providing fluid communication between said buoyancy chamber and the exterior of said housing, said port having a flow area of sufficient size to enable venting of compressed gas from said chamber upon disconnection of said riser before the buoyancy of said can extends said slip joint to its upper limit;

(b) a fail-safe valve member positioned within said housing, said valve member having a biasing means to bias said valve to a first position wherein said port is open and said valve being movable to a second position wherein said port is closed, said valve member in the open position permitting the equalization of pressure between said chamber and ambient pressure opposite said port; and (c) a closing means capable of moving said valve to said second position, said closing means becoming inoperable upon disconnection of said riser to enable said biasing means to move said valve to said first position.

2. A buoyancy can as defined in claim 1 wherein said buoyancy can is constructed for use at a depth of up to 10,000 feet and said port and said valve member are sized to permit the equalization of pressure in the buoyancy chamber with the ambient pressure opposite said port within at least 20 seconds from the time said valve member is moved from said closed position to said open position.

3. A buoyancy can as defined in claim 1 wherein said buoyancy chamber has a volume of between about 100 and about 750 cubic feet and said port has an area of between about 20 square inches and 500 square inches.

4. A buoyancy can as defined in claim 3 wherein said can includes a plurality of ports and associated valve members, the total flow area of said ports being between about 100 and about 500 square inches.

5. A buoyancy can as defined in claim 1 wherein said closing means is a hydraulic line having hydraulic pressure therein.

6. A riser system for conducting offshore drilling operations from a drilling vessel, said riser system comprising (a) a riser which extends from the vessel to a wellhead on the seafloor;

(b) a plurality of buoyancy cans spaced along said riser, each of said buoyancy cans having a port formed therein and including (i) a gas inlet for receiving gas into each buoyancy can, (ii) a valve member for closing said port, said valve member biased away from said port, a hydraulic pilot valve connected to said dump valve and being operative to move said valve member to close said port in response to the delivery of a predetermined hydraulic pressure to said pilot valve, said valve member being moveable to its normally open position in response to loss of said predetermined pressure delivered to said pilot valve;

(c) a gas line extending from said vessel to each gas inlet for introducing gas into each of said buoyancy cans; and (d) a hydraulic line extending from said vessel to each buoyancy can for delivery of hydraulic pressure to each of said pilot valves.

7. A riser system as defined in claim 6 wherein said port has an area at least ten times larger than the area of said gas inlet.

8. A riser system as defined in claim 7 wherein said port is sized to equalize pressure in said can with the pressure of the surrounding sea water within twenty seconds from loss of said predetermined hydraulic pressure.

9. A marine riser having a buoyancy can mounted at a subsea depth, the improvement wherein said buoyancy can comprises:

(a) a housing secured to said riser and defining a buoyancy chamber therein and having a port formed therein for venting gas from said buoyancy chamber;

(b) means for introducing compressed gas into said can;

(c) a valve member mounted in said chamber adjacent to said port, said valve member having first position wherein said port is closed and a second position wherein said port is open; and (d) a pilot valve having a first position where said pilot valve cooperates with said valve member to close said port and a second position where said valve member is movable to the second position wherein said port is open, said pilot valve having a hydraulic line with hydraulic pressure therein extending from the surface to said pilot valve, said hydraulic pressure being operative to move said pilot valve to said first position, said pilot valve having a biasing means to move said pilot valve to said second position when said hydraulic pressure is removed from said hydraulic line.

10. A buoyancy can as defined in claim 9 wherein said valve member is adapted to move from the first position to the second position in not more than about 0.5 seconds in response to de-energization of said pilot valve.

11. A buoyancy can as defined in claim 9 wherein said port and said valve member are sized to permit equalization of pressure between said buoyancy chamber and the sea water opposite said port within 20 seconds from de-energization of said pilot valve.

12. A buoyancy can as defined in claim 9 wherein said valve member is reciprocally movable within a valve housing between said first and second positions and wherein said pilot valve includes a piston member adapted to force said valve member to said first position in response to delivery of predetermined hydraulic pressure thereto.

13. A buoyancy can as defined in claim 12 wherein said valve member and said valve housing define an inner valve chamber, said valve member having an opening formed therein providing fluid communication between said inner valve chamber and the surrounding sea water opposite said port, and wherein said piston member is adapted to engage said valve member to close said opening in response to delivery of said predetermined hydraulic pressure to said pilot valve, pressure within said inner valve chamber being operative to maintain said valve member in the first position.

14. A buoyancy can as defined in claim 13 wherein said biasing means includes a spring urging said piston member away from said opening whereby the pressure within said inner chamber and the exterior of said housing is equalized through said opening.

15. A buoyancy can as defined in claim 14 wherein said valve member includes a flanged portion having an outwardly facing surface, said surface and the interior of said valve housing defining an outer valve chamber in fluid communication with said buoyancy chamber, and wherein said valve member includes an orifice providing fluid communication between said outer valve chamber and said inner valve chamber, the flow capacity through said orifice being substantially less than the flow capacity of said opening such that movement of said piston member away from said opening causes an equalization in said internal valve chamber with said ambient seawater pressure prior to equalization of the pressure between said external and internal valve chambers, the differential pressure between said outer valve chamber and said inner valve valve chamber acting upon said valve member to move said valve member to the second position.

16. A buoyancy can as defined in claim 15 wherein the opening, orifice and flanged portion are sized to cause said valve member to move from the closed first to the second position within 0.5 seconds from loss of said predetermined hydraulic pressure at a differential pressure between said inner and outer valve chambers of not less than 12 psi.

17. A buoyancy can for use at subsea depths which comprises:

(a) a housing defining an internal gas buoyancy chamber; said housing having a port formed therein for venting gas from said buoyancy chamber;

(b) a valve member mounted on an upper portion of said chamber adjacent to said port, said valve member being movable to close said port to retain gas in said chamber and being movable to open said port to vent gas from said chamber through said port into the surrounding sea; and (c) a pilot valve having a piston connected to said valve member and a hydraulic line having hydraulic pressure therein and extending from the surface to said piston, said pilot valve having biasing means for biasing said piston away from said valve member, said hydraulic pressure in said line urging said piston towards said valve member to cause said valve member to be moved to said closed position, said biasing means moving said piston away from said valve member with the loss of hydraulic pressure to enable said valve member to be moved to said open position.

18. A buoyancy can as defined in claim 17 wherein said housing is constructed in two complementary-shaped housing members defining separate buoyancy chambers, said housing members being adapted to be mounted on a marine riser at a subsea location; and wherein the can further includes conduit means for providing fluid communication between the two buoyancy chambers.

19. A buoyancy can as defined in claim 18 wherein each housing member is provided with said port and said valve member.

20. A riser system for use in marine drilling, which comprises:

(a) a riser;

(b) a plurality of compressed gas buoyancy cans secured to the riser to provide a net positive buoyancy on the riser;

(c) a normally open valve member mounted in each of said cans for releasing gas therefrom; and (d) hydraulic valve control means including a hydraulic pilot valve operatively connected to each of said valve members and a hydraulic line extending from the surface to each of said pilot valves, each pilot valve being operative to move said valve member to a closed position in response to delivery of a predetermined hydraulic pressure in said hydraulic line and being operative to enable said valve member to move to said open position in response to loss of said predetermined pressure in said hydraulic line, said cans being spaced along said riser such at least one valve member will move to the open position within one second from loss of said predetermined pressure of said hydraulic control means.

21. A riser system as defined in claim 20 wherein said riser further includes a sufficient member of buoyancy modules uniformly interspersed with said buoyancy cans to provide the riser with at least 90% neutral buoyancy with the air cans filled with water.

22. A riser system as defined in claim 21 wherein the buoyancy modules are made of syntactic foam.

* * * * *